US009341157B2

(12) United States Patent
Petrosian

(10) Patent No.: US 9,341,157 B2
(45) Date of Patent: May 17, 2016

(54) CATALYTIC FUEL IGNITER

(71) Applicant: Jake Petrosian, North Hollywood, CA (US)

(72) Inventor: Jake Petrosian, North Hollywood, CA (US)

( * ) Notice: Subject to any disclaimer, the term of this patent is extended or adjusted under 35 U.S.C. 154(b) by 297 days.

(21) Appl. No.: 14/107,880

(22) Filed: Dec. 16, 2013

(65) Prior Publication Data

US 2015/0275843 A1 Oct. 1, 2015

Related U.S. Application Data

(60) Provisional application No. 61/738,051, filed on Dec. 17, 2012.

(51) Int. Cl.
*F02P 23/02* (2006.01)
*F23Q 11/04* (2006.01)
*F02B 43/10* (2006.01)

(52) U.S. Cl.
CPC ..... *F02P 23/02* (2013.01); *F23Q 11/04* (2013.01); *F02B 43/10* (2013.01)

(58) Field of Classification Search
CPC ..... F02B 51/02; F02P 23/02; F23Q 11/04; Y02T 10/126
USPC ..... 123/143 A, 143 B, 143 R, 145 A, 169 R, 123/169 EL, 169 PA, 169 PB, 153, 260, 670; 431/267–271
See application file for complete search history.

(56) References Cited

U.S. PATENT DOCUMENTS 4,207,055 A * 6/1980 Tanaka ..... F23Q 2/30 431/256
4,425,495 A * 1/1984 Cake ..... G21C 9/001 123/145 A
4,452,189 A * 6/1984 Latsch ..... F02B 19/12 123/143 B
4,970,427 A * 11/1990 Scharnweber ..... F02P 13/00 123/153
5,105,780 A * 4/1992 Richardson ..... H01T 13/54 123/169 PA
5,146,881 A * 9/1992 Pfefferle ..... F02P 23/02 123/145 A
5,283,499 A * 2/1994 Adam ..... H01R 13/2421 123/169 R
5,421,299 A * 6/1995 Cherry ..... F02B 19/1004 123/260
6,058,918 A 5/2000 Noetzlin
6,076,493 A * 6/2000 Miller ..... F23Q 7/001 123/145 A
6,293,232 B1 * 9/2001 Allen ..... F02B 25/14 123/257
6,363,898 B1 * 4/2002 Ripma ..... H01T 13/08 123/142.5 E
7,077,115 B2 * 7/2006 Weber ..... F02B 43/00 123/145 A
7,104,246 B1 * 9/2006 Gagliano ..... F02B 19/1014 123/169 PA
8,353,283 B2 * 1/2013 Oglesby ..... F23D 14/18 126/414
8,418,668 B2 * 4/2013 Shimizu ..... F02P 9/007 123/143 B
2002/0185103 A1 * 12/2002 Elliott ..... F02M 51/04 123/297
2003/0192519 A1 * 10/2003 Katayama ..... F02P 3/02 123/634
2004/0149256 A1 * 8/2004 Dye ..... F02M 27/04 123/297
2006/0048732 A1 * 3/2006 Schmidt ..... F02P 23/045 123/143 B
2009/0260592 A1 * 10/2009 Niwa ..... F02B 23/101 123/143 B
2009/0297999 A1 * 12/2009 Jensen ..... F23Q 11/00 431/268

* cited by examiner

*Primary Examiner* — John Kwon
*Assistant Examiner* — Johnny H Hoang
(74) *Attorney, Agent, or Firm* — Kenneth L. Green; Averill & Green

(57) ABSTRACT

A catalytic fuel igniter is compatible with internal combustion engines and other chemical fuel operated systems. The catalytic fuel igniter does not require electrical components typically required for such systems, thus reducing complexity. The catalytic fuel igniter includes a catalyst in a controlled environment which ignites the fuel and air at the proper time for engine operation. In one embodiment the fuel is a hydrogen fuel and the catalytic fuel igniter is a hydrogen fuel igniter.

12 Claims, 4 Drawing Sheets

CATALYTIC FUEL IGNITER

The present application claims the priority of U.S. Provisional Patent Application Ser. No. 61/738,051 filed Dec. 17, 2012, which application is incorporated in its entirety herein by reference.

BACKGROUND OF THE INVENTION

The present invention relates to the ignition of internal combustion engines and in particular to a catalytic ignition device for hydrogen fuel internal combustion engines.

Fossil fuels pose environmental and health challenges. Also, environmental regulations which require companies to develop complex and expensive emission controls have not been effective in completely eliminating the build-up of carbon dioxide and nitrogen oxide compounds in the atmosphere.

Conventional combustion technologies require carbon based fuel and an oxidizer to be ignited by a spark plug or heating element (e.g., glow plug) utilizing a magnetic/electrical coil or electrical feed. Generally ignition systems are required to provide an electrical signal, and these ignition systems often fail.

As an alternative to complex fossil fuels, hydrogen is gaining popularity in the world. Hydrogen is safe to use and abundant in nature. In a gaseous form, hydrogen chemically reacts with air to form water as the main product of an exothermic (energy releasing) reaction. The combustion of hydrogen and air delivers approximately 1.5 times more BTU than carbon fuel (e.g., gasoline). However, some form of efficient ignition is still required for hydrogen fueled internal combustion engines.

BRIEF SUMMARY OF THE INVENTION

The present invention addresses the above and other needs by providing a catalytic fuel igniter which is compatible with internal combustion engines and other chemical fuel operated systems. The catalytic fuel igniter does not require electrical components typically required for such systems, thus reducing complexity. The catalytic fuel igniter includes a catalyst in a controlled environment which ignites the fuel and air at the proper time for engine operation. In one embodiment the fuel is a hydrogen fuel and the catalytic fuel igniter is a hydrogen fuel igniter.

In accordance with one aspect of the invention, there is provided a catalytic fuel igniter which eliminates the need for an electrical ignition system for hydrogen fuel. The catalytic fuel igniter reduces the cost of materials used and increases the efficiency of the hydrogen combustion reaction thereby increasing the efficiency of the engine.

In accordance with another of the invention, there is provided a catalytic fuel igniter including female fitting including a threaded passage therethrough, a male fitting having a male threaded portion cooperating with the threaded passage of the female fitting attachment of the male fitting of the top of the female fitting, a closed end of the threaded passage opposite the male fitting, the closed end including slits and sides containing orifices, a catalytic plug residing in the threaded passage at the closed end, a spring residing in the threaded passage above the catalytic plug, and a set screw residing in the threaded passage above the spring and threadedly cooperating with the threaded passage to advance and retreat the within the threaded passage by turning the set screw.

In accordance with still another of the invention, there is provided a catalytic plug made using a method including washing porous white alumina with distilled water, drying the washed alumina with hydrogen gas flame, saturating the dried alumina with two drops of concentrated Chloroplatinic acid, reducing with excess 5-7 mL diluted Sodium Hydroxymethane Sulfinate solution heated to at least 78° Celsius to make platinized alumina, drying the platinized alumina using a hydrogen flame, placing one drop of concentrated Chloroplatinic acid on the platinized alumina, decomposing with hydrogen flame until visible silver platinum is deposited in the pores, and bringing the alumina catalyst to room temperature and introduce hydrogen gas to re-generate the catalyst.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
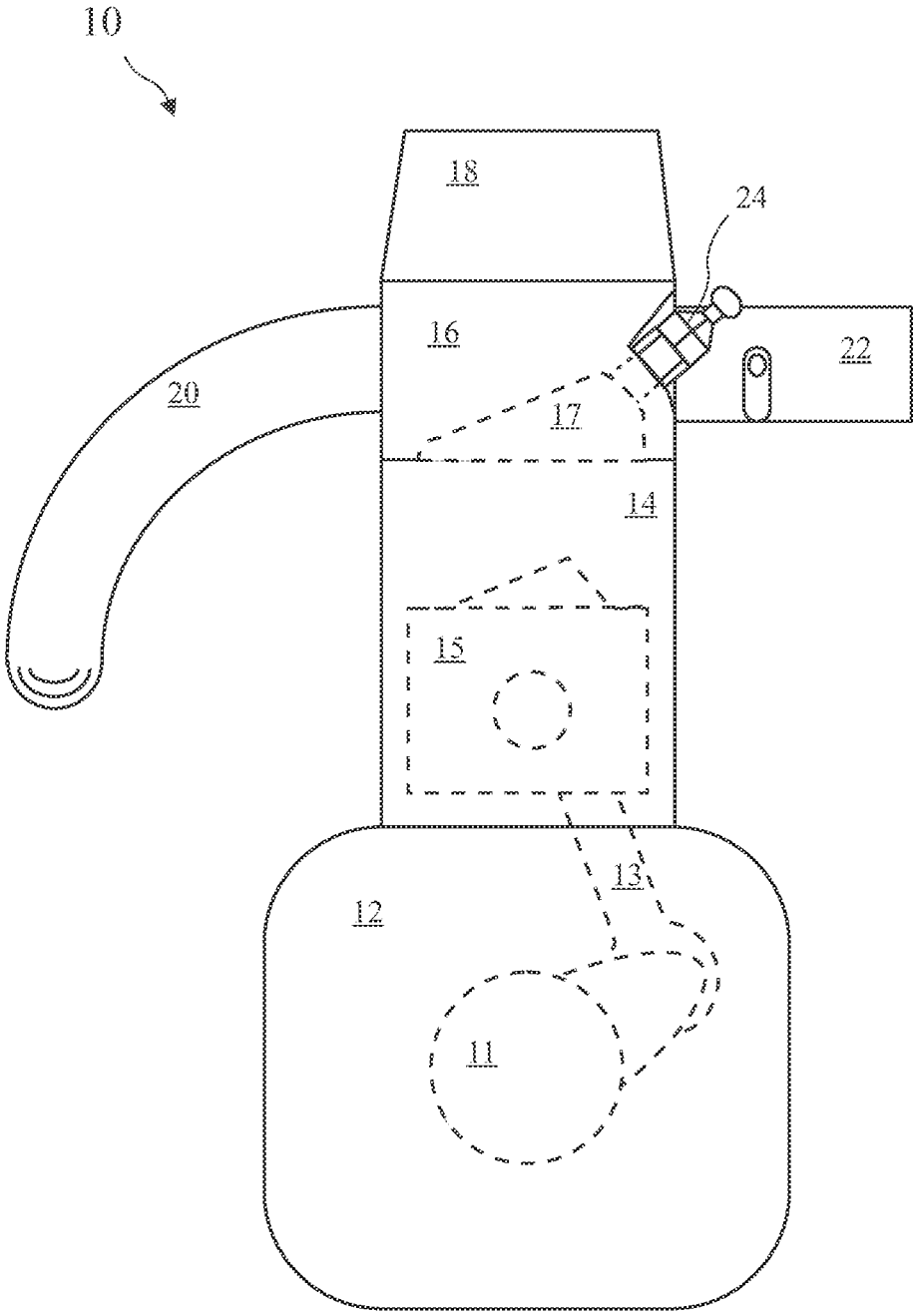
FIG. 1 is an internal combustion engine having a catalytic fuel igniter according to the present invention.

A catalytic ignition engine 10 having a catalytic fuel igniter 24 according to the present invention is shown in FIG. 1. The engine 10 includes an engine block 12, a cylinder 14, a head 16, a valve cover 18, exhaust 20, and an air intake 22. The engine 10 includes internal components including a crank shaft 11 residing in the engine block 12, a connecting rod 13 connected to the crank shaft 11, a piston 15 connected to the connecting rod 13, and a combustion chamber 17 in the head 16 above the piston 15. The engine 10 further includes other internal and external parts known to those skilled in the art and not described here. The catalytic fuel igniter 24 may be attached at the location otherwise used by a spark plug or glow plug, or in a location provided specifically for the catalytic fuel igniter 24.

Figure 2C:
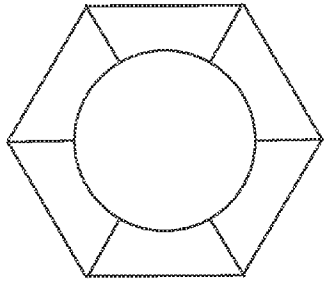
FIG. 2C is a top view of the male fitting of the catalytic fuel igniter according to the present invention.
Figure 2A:
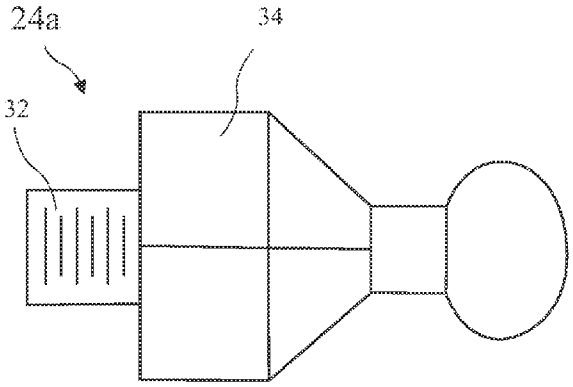
FIG. 2A is a side view of a male fitting of the catalytic fuel igniter according to the present invention.
Figure 2B:
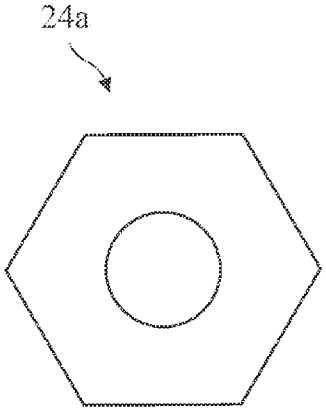
FIG. 2B is a bottom view of the male fitting of the catalytic fuel igniter according to the present invention.

A side view of a male fitting 24*a* of the catalytic fuel igniter 24 is shown in FIG. 2A, a bottom view of the male fitting 24*a* is shown in FIG. 2B, and a top view of the male fitting 24*a* is shown in FIG. 2C. The male fitting 24*a* includes a male threaded portion 32 and a wrench attachment portion 34.

Figure 3C:
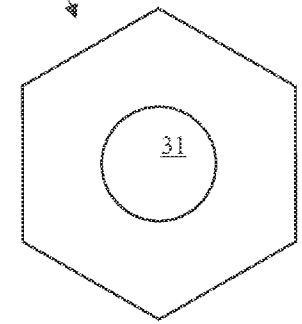
FIG. 3C is a top view of the female fitting of the catalytic fuel igniter according to the present invention.
Figure 3A:
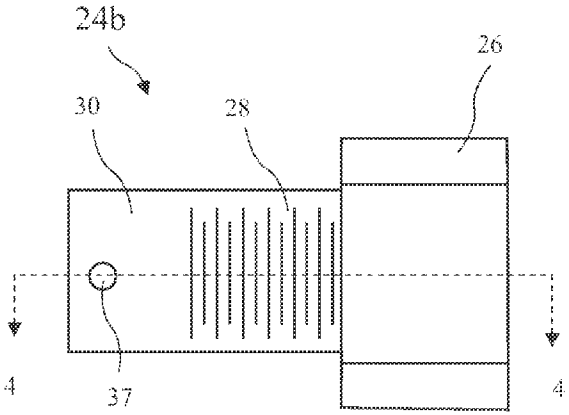
FIG. 3A is a side view of a female fitting of the catalytic fuel igniter according to the present invention.
Figure 3B:
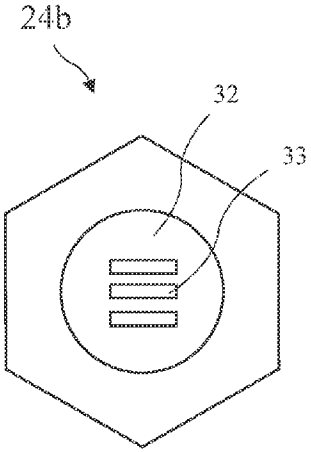
FIG. 3B is a bottom view of the female fitting of the catalytic fuel igniter according to the present invention.
Figure 4:
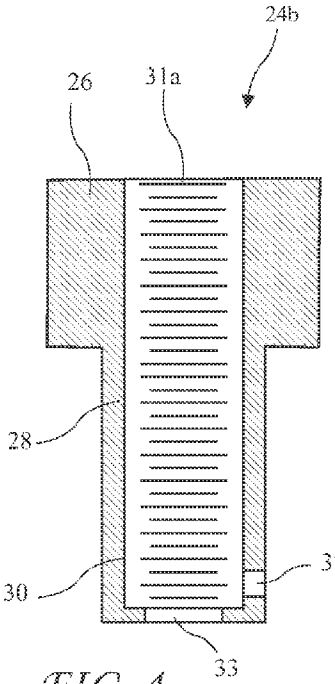
FIG. 4 is a cross-sectional view of the female fitting according to the present invention, taken along line 4-4 of FIG. 3A.

A side view of a female fitting 24*b* of the catalytic fuel igniter 24 is shown in FIG. 3A, a bottom view of the female fitting 24*b* is shown in FIG. 3B, a top view of the female fitting is shown in FIG. 3C, and a cross-sectional view of the female fitting 24*b* taken along line 4-4 of FIG. 3A is shown in FIG. 4. The female fitting 24*b* includes a threaded passage 31 substantially therethrough (i.e., reaching nearly the entire length of the female fitting 24*b*), having an open end 31*a* for threadedly receiving the male fitting 24*a*, and an opposite closed end 32 having slits 33 and passages 37. The female fitting 24*b* includes male threads 28 for attachment to the engine 10, an unthreaded portion 30, and a wrench attachment portion 26 for tightening to the engine 10. The wrench attachment portions 26 and 34 may be for a common ⅝ inch wrench, and the male threads may be a common spark plug thread of 14.125 mm.

Figure 5B:
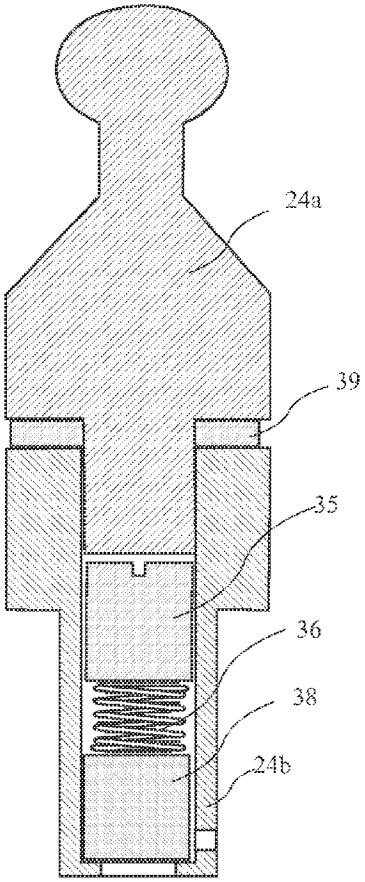
FIG. 5B is a cross-sectional view of the assembled catalytic fuel igniter according to the present invention.
Figure 5A:
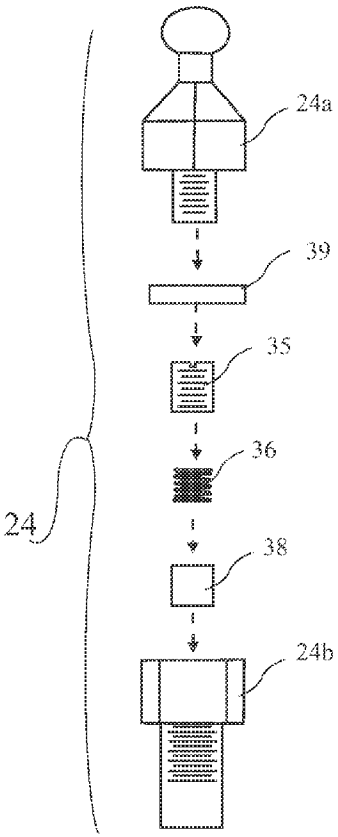
FIG. 5A is an exploded view of the catalytic fuel igniter according to the present invention.

An exploded view of the catalytic fuel igniter 24 is shown in FIG. 5A and an assembled view of the catalytic fuel igniter 24 is shown in FIG. 5B. The catalytic fuel igniter 24 includes the female fitting 24*b* including the threaded passage 31 therethrough, the male fitting 24*a* attachable to the top of the female fitting 24*b*, a catalytic plug 38 residing in the threaded passage 31 at the closed end 32, a spring residing in the threaded passage 31 above the catalytic plug 38, a set screw 35 residing in the threaded passage 31 above the spring 36 and threadedly cooperating with the threaded passage 31 to advance and retreat the within the threaded passage 31 by turning the set screw 35, and a compressible gasket (or seal) 39 captured between the female fitting 24*b* and the male fitting 24*a*. The spring 36 and set screw 35 allow adjustment of force exerted against the catalytic plug 38 to hold the catalytic plug 38 in place and avoid cracks or other damage to the catalytic plug 38. The compressible gasket 39 fills the gap between the male and female fitting when the male fitting 24*a* is tightened against the set screw 35. The set screw 35 is a hydrogen compatible material, for example, brass. The male fitting 24*a* tightens against the set screw 35 to prevent loosening the up from heat expansion. The orifices 37 is preferably aligned with the catalytic plug 38 to facilitate saturation of the catalytic plug 38 with hydrogen fuel, and some of the hydrogen fuel generally flows upward past the catalytic plug 38, thus surrounding the catalytic plug 38.

Figure 6:
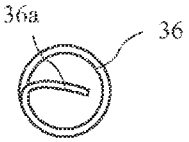
FIG. 6 is a bottom view of a spring element of the catalytic fuel igniter according to the present invention.

A bottom view of the spring 36 is shown in FIG. 6. The spring 36 has an inward folded bottom coil 36*a* to rest against the catalytic plug 38.

Figure 7:
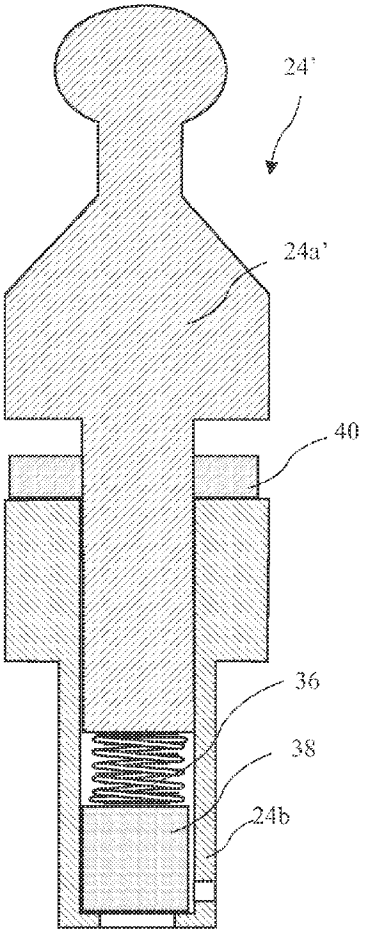
FIG. 7 is another embodiment of a catalytic fuel igniter according to the present invention.

Another embodiment of the catalytic fuel igniter 24' is shown in FIG. 7. The catalytic fuel igniter 24' includes a male fitting 24*a*' and locking nut 40 for fixing the depth of the male fitting 24*a*' in the interior passage 31 of the female fitting 24*b* to apply force to the catalytic plug 38.

Figure 8:
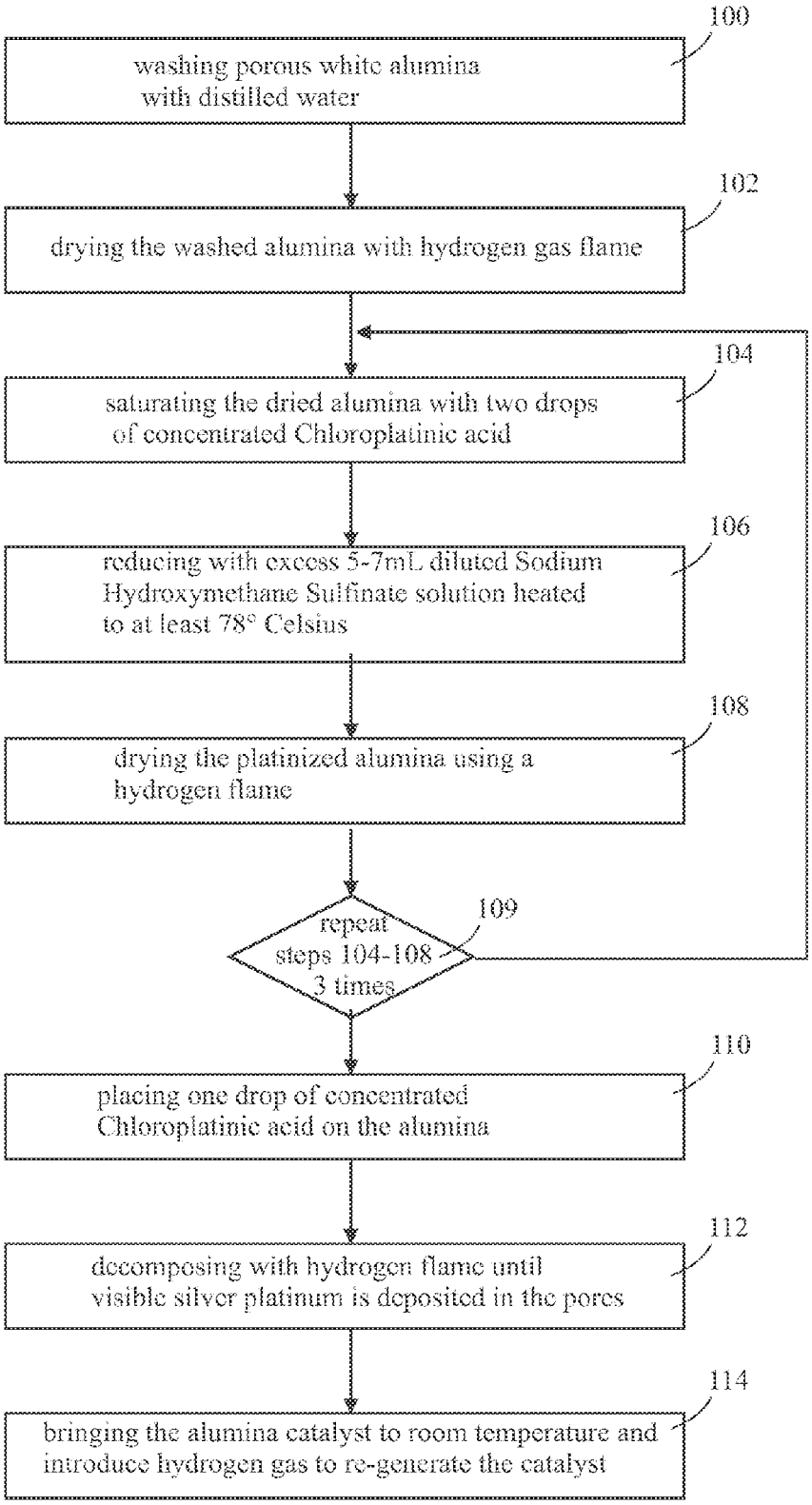
FIG. 8 is a process for making a catalyst plug according to the present invention.

A process for making a catalyst plug 38 according to the present invention is described in FIG. 8. The method includes washing porous white alumina with distilled water at step 100, drying the washed alumina with hydrogen gas flame at step 102, saturating the dried alumina with two drops of concentrated Chloroplatinic acid at step 104, reducing with excess 5-7 mL diluted Sodium Hydroxymethane Sulfinate solution heated to at least 78° Celsius to make platinized alumina at step 106, drying the platinized alumina using a hydrogen flame at step 108, repeating steps 104, 106, and 108 at least 3 times at step 109, placing one drop of concentrated Chloroplatinic acid on the platinized alumina at step 110, decomposing with hydrogen flame until visible silver platinum is deposited in the pores at step 112, and bringing the alumina catalyst to room temperature and introduce hydrogen gas to re-generate the catalyst at step 114.

While alumina is a preferred material for making the catalyst plug 38, alternative materials include other solid material porous which can be platinized. The catalytic fuel igniter 24 may also be used for starting jet engines and as an igniter for rocket engines. An igniter according to the present invention may further be used with methane, butane, and propane fuels with a modified catalyst.

While other materials may be used, examples of suitable materials for the male fitting and female fitting are 303 stainless, 304 stainless and 314 stainless.

While the invention herein disclosed has been described by means of specific embodiments and applications thereof, numerous modifications and variations could be made thereto by those skilled in the art without departing from the scope of the invention set forth in the claims.

I claim:

1. A catalytic fuel igniter comprising:
- a female fitting including an interior passage substantially therethrough;
- an open end of the interior passage;
- a closed end of the interior passage opposite the open end;
- at least one slit through the closed end of the interior passage;
- a male fitting engagable with the female fitting to close the open end of the interior passage of the female fitting; and
- a catalytic plug residing in the interior passage at the closed end and in fluid communication with an exterior of the catalytic fuel igniter through the at least one slit,
- wherein the catalytic plug is made using the process:
  - washing porous white alumina with distilled water;
  - drying the washed alumina with hydrogen gas flame;
  - saturating the dried alumina with two drops of concentrated Chloroplatinic acid;
  - reducing with excess 5-7 mL diluted Sodium Hydroxymethane Sulfinate solution heated to at least 78° Celsius to make platinized alumina;
  - drying the platinized alumina using a hydrogen flame;
  - placing one drop of concentrated Chloroplatinic acid on the platinized alumina;
  - decomposing with hydrogen flame until visible silver platinum is deposited in the pores; and
  - bringing the alumina catalyst to room temperature and introduce hydrogen gas to re-generate the catalyst.

2. The catalytic fuel igniter of claim 1, wherein the catalytic plug is held against the closed end of the interior passage.

3. The catalytic fuel igniter of claim 2, wherein cooperation of the male fitting with the female fitting holds the catalytic plug against the closed end of the interior passage.

4. The catalytic fuel igniter of claim 3, wherein a portion of the male fitting resides in the interior passage of the female fitting holding the catalytic plug against the closed end of the interior passage.

5. The catalytic fuel igniter of claim 2, wherein a set screw resides in the interior passage of the female fitting, the set screw holding the catalytic plug against the closed end of the interior passage.

6. The catalytic fuel igniter of claim 5, wherein a spring resides between the set screw and the catalytic plug in the interior passage of the female fitting, the spring holding the catalytic plug against the closed end of the interior passage.

7. The catalytic fuel igniter of claim 1, wherein:

the interior passage of the female fitting includes female threads;

the male fitting includes male threads on a cooperating portion residing in the interior passage of the female fitting, the make and female threads attaching the male fitting to the female fitting.

8. The catalytic fuel igniter of claim 1, further including orifices in walls of the interior passages adjacent to the catalytic plug.

9. A process for making a catalytic plug, comprising:

washing porous white alumina with distilled water;

drying the washed alumina with hydrogen gas flame;

saturating the dried alumina with two drops of concentrated Chloroplatinic acid;

reducing with excess 5-7 mL diluted Sodium Hydroxymethane Sulfinate solution heated to at least 78° Celsius to make platinized alumina;

drying the platinized alumina using a hydrogen flame;

placing one drop of concentrated Chloroplatinic acid on the platinized alumina;

decomposing with hydrogen flame until visible silver platinum is deposited in the pores; and bringing the alumina catalyst to room temperature and introduce hydrogen gas to re-generate the catalyst.

10. The process for making a catalytic plug of claim 9, further including placing the catalytic plug in an interior passage of a catalytic fuel igniter, comprising:

a female fitting including the interior passage substantially therethrough;

an open end of the interior passage;

a closed end of the interior passage opposite the open end;

a male fitting engageable with the female fitting to close the open end of the interior passage of the female fitting;

the catalytic plug in fluid communication with an exterior of the catalytic fuel igniter through at least one opening.

11. A catalytic fuel igniter comprising:

a female fitting including an interior passage substantially therethrough;

an open end of the interior passage;

a closed end of the interior passage opposite the open end;

at least one slit through the closed end of the interior passage;

a male fitting engageable with the female fitting to close the open end of the interior passage of the female fitting;

a catalytic plug residing in the interior passage at the closed end and in fluid communication with an exterior of the catalytic fuel igniter through the at least one slit, the catalytic plug is made using a method comprising:

washing porous white alumina with distilled water;

drying the washed alumina with hydrogen gas flame;

saturating the dried alumina with two drops of concentrated Chloroplatinic acid;

reducing with excess 5-7 mL diluted Sodium Hydroxymethane Sulfinate solution heated to at least 78° Celsius to make platinized alumina;

drying the platinized alumina using a hydrogen flame;

placing one drop of concentrated Chloroplatinic acid on the platinized alumina;

decomposing with hydrogen flame until visible silver platinum is deposited in the pores; and bringing the alumina catalyst to room temperature and introduce hydrogen gas to re-generate the catalyst.

12. The process for making a catalytic plug of claim 10, further including configuring the catalytic fuel igniter to reside in a catalytic ignition engine comprising:

an engine block;

an exhaust;

an air intake;

a combustion chamber; and the catalytic fuel igniter is in fluid communication with the combustion chamber.

* * * * *